US005286316A

United States Patent [19]

Wade

[11] Patent Number: 5,286,316

[45] Date of Patent: Feb. 15, 1994

[54] HIGH EXTRUDABILITY, HIGH CORROSION RESISTANT ALUMINUM-MANGANESE-TITANIUM TYPE ALUMINUM ALLOY AND PROCESS FOR PRODUCING SAME

[75] Inventor: Kenneth D. Wade, Midlothian, Va.

[73] Assignee: Reynolds Metals Company, Richmond, Va.

[21] Appl. No.: 862,896

[22] Filed: Apr. 3, 1992

[51] Int. Cl.[5] ..... C22F 1/04; C22C 21/04

[52] U.S. Cl. ..... 148/550; 148/689; 148/695; 148/415; 148/437; 420/537; 420/538; 420/551; 420/553

[58] Field of Search ..... 148/550, 689, 695, 415, 148/437; 420/537, 538, 551, 553

[56] References Cited

U.S. PATENT DOCUMENTS

| | | | |
|---|---|---|---|
| Re. 18,552 | 8/1932 | Taylor et al. | 420/553 |
| 4,499,050 | 2/1985 | Tong | 420/528 |
| 4,649,087 | 3/1987 | Scott et al. | 420/537 |
| 4,828,794 | 5/1989 | Scott et al. | 420/537 |
| 4,851,192 | 7/1989 | Baba et al. | 420/553 |

FOREIGN PATENT DOCUMENTS

| | | |
|---|---|---|
| 2904219 | 8/1979 | Fed. Rep. of Germany . |
| 9114794 | 10/1991 | PCT Int'l Appl. . |

*Primary Examiner*—R. Dean
*Assistant Examiner*—Robert R. Koehler
*Attorney, Agent, or Firm*—Alan M. Biddison

[57] ABSTRACT

An aluminum-based alloy composition having improved corrosion resistance and high extrudability consists essentially of about 0.1–0.5% by weight of manganese, about 0.05–0.12% by weight of silicon, about 0.10–0.20% by weight of titanium, about 0.15–0.25% by weight of iron and the balance aluminum, wherein the aluminum alloy is essentially copper free. The inventive alloy is useful in automotive applications, in particular, heat exchanger tubing and finstock, and foil packaging. The process provided by the invention uses a high extrusion ratio and produces a product having high corrosion resistance.

17 Claims, 7 Drawing Sheets

| DAYS EXPOSURE | 15 | 18 | 20 | 22 | 25 |
|---|---|---|---|---|---|
| ALLOY E ----- | 41 | 48 | 48 | 48 | n.t. |
| ALLOY F --- | 16 | 20 | 35 | 37 | n.t. |
| INV.-3 ——— | 0 | 5 | 11 | 11 | 15 |

HIGH EXTRUDABILITY, HIGH CORROSION RESISTANT ALUMINUM-MANGANESE-TITANIUM TYPE ALUMINUM ALLOY AND PROCESS FOR PRODUCING SAME

FIELD OF THE INVENTION

This invention relates to an improved aluminum-manganese-titanium alloy and more particularly relates to an aluminum alloy which is essentially copper-free and is characterized by the combination of high extrudability and high corrosion resistance. The invention also provides a process including a high extrusion ratio for producing a product having high corrosion resistance.

BACKGROUND OF THE INVENTION

In the automotive industry, aluminum alloys are used extensively for tubing because of the extrudability of the alloys as well as the combination of lightweight and high strength. Alloys for use in the automotive industry, especially for heat exchanger or air conditioning condenser applications, must have excellent strength, corrosion resistance and extrudability.

One example of a prior art aluminum alloy for use in air conditioning condensers is an AA 1000 series aluminum alloy. As a result of the improvements in automotive heat exchangers, condensers were designed with reduced wall thickness to meet the needs of new refrigerants and weight reduction. As such, the AA 1000 series materials, typically having yield stresses of about 1.5 ksi, were replaced with more highly alloyed aluminum alloys such as AA 3102, typically having a yield stress of about 2.5 ksi.

Requirements for more efficient condenser design have created a demand for aluminum alloys with strength similar to the AA 3102 type alloys but with improved corrosion resistance.

U.S. Pat. Nos. 4,649,087 and 4,828,794 describe the use of a titanium addition to an aluminum-manganese alloy to impart superior corrosion performance. The alloys described in these patents are useful for extrusions with an extrusion ratio (ratio of billet cross-sectional area to the cross-sectional area of the extrusion) less than about 200. When using extrusion ratios higher than 200, for instance a ratio on the order of 500 or more, alloys of the type described in these patents require extremely high extrusion forces to achieve these ratios. As such, these manganese, copper, and titanium containing aluminum alloys are not economical in extrusion applications with high extrusion ratios.

In view of the disadvantages of prior art alloys having superior corrosion resistance but reduced extrudability properties, and industry requirements for small cross-sectional areas and thin wall dimensions for extrusions used in condensers, a need has developed for aluminum alloy compositions having the combination of excellent extrudability and superior corrosion resistance. Excellent extrudability is required to minimize production costs at the extrusion plant, including use of lower extrusion pressures and higher extrusion speeds.

In response to this need, the present invention provides an aluminum alloy composition which exhibits superior corrosion resistance and improved extrudability. The aluminum alloy of the present invention includes controlled amounts of manganese, iron, silicon and titanium. The copper content is limited to greatly improve the extrudability of the alloy and to offset the effect of the titanium alloying component which causes the flow stress of the aluminum alloy to be higher than alloys without the addition of titanium.

SUMMARY OF THE INVENTION

It s accordingly a first object of the present invention to provide an aluminum-based alloy having controlled amounts of manganese, silicon, titanium and iron, the aluminum-based alloy being essentially copper free and having the combination of superior corrosion resistance and high extrudability.

It is a further object of the present invention to provide an aluminum-based alloy suitable for use in heat exchanger tubing or extrusions.

It is another object of the present invention to provide an aluminum-based alloy suitable for use as finstock for heat exchangers or in foil packaging applications subjected to corrosion, for instance, from salt water.

It is still another object of the present invention to provide a process using a high extrusion ratio to produce a product having high corrosion resistance.

Other objects and advantages of the present invention will become apparent as the description thereof proceeds.

In satisfaction of the foregoing objects and advantages, there is provided by the present invention an aluminum-based alloy consisting essentially of about 0.1–0.5% by weight of manganese, about 0.05–0.12% by weight of silicon, about 0.10–0.20% by weight of titanium, about 0.15–0.25% by weight of iron and the balance aluminum and incidental impurities, wherein the aluminum alloy is essentially copper free. Other impurities are preferably not more than 0.05% by weight each and not more than 0.15% by weight total. Even more preferably, other impurities are not more than 0.03% by weight each and not more than 0.10% by weight total. It should be understood that the term "balance aluminum", as used hereinafter, is not intended to exclude the presence of incidental impurities.

In a preferred embodiment, the copper content as an impurity is limited to an amount between zero and not more than 0.01% by weight to permit high extrudability in combination with superior corrosion resistance.

The present invention also includes products utilizing the inventive alloy compositions such as extrusions, tubing, finstock and foil.

BRIEF DESCRIPTION OF DRAWINGS

Reference is now made to the Drawings accompanying the invention wherein.

DESCRIPTION OF THE PREFERRED EMBODIMENTS

Figure 1:
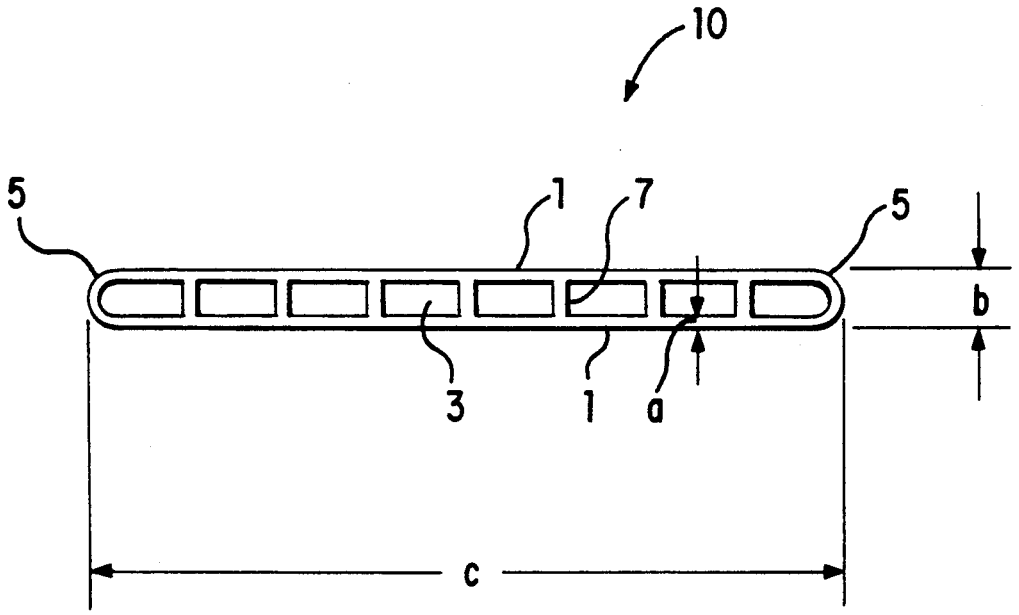
FIG. 1 shows an exemplary multivoid tubing made from a preferred inventive alloy composition.

The present invention is directed to an improved aluminum-manganese-titanium alloy having the combination of excellent corrosion resistance and high extrudability characteristics. The aluminum-based alloy of the present invention consists essentially of about 0.1–0.5% by weight of manganese (preferably between about 0.25 and 0.35% by weight of manganese), about 0.05–0.12% by weight of silicon, about 0.10–0.20% by weight of titanium preferably between about 0.12 and 0.17% by weight), about 0.15–0.25% by weight of iron and the balance aluminum, wherein the aluminum alloy is essentially copper-free. Other elements that may be present include not more than 0.03% by weight of Mg, not more than 0.05% by weight of Zn, and not more than 0.003% by weight of B. The term "copper-free" means that the amount of copper is controlled to an impurity level such that the level of copper in the alloy composition does not exceed about 0.03% by weight, preferably the amount of copper does not exceed 0.01% by weight.

In a preferred embodiment, the aluminum-based alloy consists essentially of about 0.01% by weight of copper, about 0.22% by weight of manganese, about 0.10% by weight of silicon, about 0.21% by weight of iron, about 0.14 to 0.16% by weight of titanium and the balance aluminum. In a more preferred embodiment, the copper content is controlled to less than 0.01% by weight.

The iron and silicon contents of the inventive aluminum-based alloy should be controlled such that the amount of iron is less than 2.5 times the amount of silicon in the alloy to avoid forming $FeAl_3$. Moreover, the manganese amount should be greater than or equal to twice the amount of silicon to encourage formation of $MnAl_6$. It should be understood that the amounts above and hereinafter refer to weight percent.

It has been discovered that both superior corrosion resistance and high extrudability are obtained in the alloy of the present invention by controlling the copper content. As a result of the controlled copper content, high extrusion ratios, for example, greater than 200, including ratios in excess of 500, coupled with superior corrosion performance, are attained. The high extrudability characteristics of the inventive alloy result in production of high quality, corrosion resistant, bendable, small cross-section tubing which is especially adapted for automotive air conditioning condenser assembly use.

The superior corrosion resistance is attributable in art to the mode of corrosion attack being limited to generally a lamellar type which extends the time required for corrosion to penetrate through a given thickness and thereby providing a long life alloy.

In a further embodiment of the present invention, more preferred ranges of the manganese content and titanium content include about 0.20–0.35% by weight of manganese and about 0.11–0.17% by weight of titanium.

In an effort to demonstrate the improvements associated with the inventive aluminum-based alloy over known prior art alloys, properties related to homogenization practice, mechanical properties, corrosion resistance and extrudability were investigated. The following description details the techniques used to investigate these properties and discussion of the results of the investigation.

Eight compositions were selected for comparison purposes with two preferred inventive alloy compositions. The eight compositions as cast are listed in Table I. The nominal compositions of known Alloy A, Alloy B, Alloy C and Alloy D were selected as a base line for comparison. The Alloy C and D compositions represent two different levels of manganese.

Another composition was cast, designated as Al—Mn—Cu which was similar to the Alloy A alloy but with high copper.

Preferred embodiments of the inventive alloy are depicted in Table I as Inv 1 and Inv 2. Inv 1 contains 0.01% copper with Inv 2 containing less than 0.01% copper.

Compositions in Table I include those with and without titanium to verify the effectiveness of titanium in altering the mode of corrosion attack regardless of copper or manganese content. The alloy compositions in Table I were cast as extrusion billets using conventional foundry techniques. Two logs, each being three inches in diameter by 72 inches long, were cast and then stress relieved at 500° F. As needed, the billets were cut into 9–10 inch lengths. The as-cast billets were first utilized in a homogenization study to determine homogenization practice. Following the homogenization study, billets were extruded to faciliate investigation of mechanical properties and corrosion resistance.

TABLE I

| | Compositions of extrusion billets and reference alloy designations | | | | | | |
|---|---|---|---|---|---|---|---|
| | Si | Fe | Cu | Mn | Ti | Zn | others |
| #43 Alloy C | .07 | .22 | .08 | .30 | .14 | .01 | <.01 |
| #47 Alloy B | .07 | .22 | .29 | .30 | .14 | .01 | <.01 |
| *#56 Inv 1 | .10 | .21 | .01 | .22 | .14 | <.01 | <.01 |
| *#57 Inv 2 | .10 | .21 | <.01 | .33 | .15 | <.01 | <.01 |
| #60 Alloy A | .10 | .22 | .08 | .35 | <.01 | <.01 | <.01 |
| #61 Al—Mn—Cu | .10 | .22 | .24 | .35 | <.01 | <.01 | <.01 |
| #62 Alloy D | .10 | .22 | .08 | .20 | .16 | <.01 | <.01 |
| #63 Al—.25Cu—Ti | .10 | .22 | .25 | <.01 | .15 | <.01 | <.01 |

*inventive alloy preferred composition

For investigating extrudability properties, a second set of billets were cast and homogenized. The details of the extrudability study will be discussed hereinafter.

Homogenization practice is important in determining the tensile properties and extrudability of aluminum alloys. Once the billets were cast, one inch thick samples were cut from each three inch diameter log to be used for the homogenization study. The electrical conductivity of each of the as-cast samples was measured by an eddy current method. The samples were homogenized at 950° F. and 1100° F. for a number of time periods and subsequently water quenched. The eddy current conductivity was then measured on each sample. Moreover, some samples were held for 24 hours at each temperature and were cooled at a controlled slow rate to below 400° F. followed by conductivity measurement.

In casting, most of the manganese precipitates from the liquid to form constituent particles. Because of the fairly rapid cooling rate in casting an ingot, some of the manganese is held in solid solution. Homogenization practice is intended to precipitate the remaining manganese as a dispersoid. The size and distribution of the constituents and dispersoids and the amount of manganese in solution have a major influence on extrudability by virtue of the influence of the material flow stress. By measuring electrical conductivity, an indication of the amount of manganese in solution can be determined. Consequently, monitoring of conductivity and microstructure enables analysis of the effect of homogenization on a given alloy.

Table II shows a chart of the conductivity of the eight compositions listed in Table I in the as-cast condition, homogenized at 950° F. and homogenized at 1100° F. As is evident from Table II, homogenization increases the electrical conductivity of compositions containing manganese. The as-cast alloy compositions exhibited the lowest electrical conductivity.

TABLE II

Conductivity of the eight compositions as cast and after homogenization for 24 hours plus a slow cool, %IACS

| | As Cast (1) | 950° F. (2) | 1100° F. (2) |
|---|---|---|---|
| Alloy C | 40.8 | 45.2 | 44.0 |
| Alloy B | 39.6 | 44.0 | 42.5 |
| Inv 1 | 45.0 | 49.0 | 48.3 |
| Inv 2 | 41.3 | 46.5 | 45.1 |
| Alloy A | 45.6 | 52.2 | 50.7 |
| Al—Mn—Cu | 44.8 | 51.2 | 49.9 |
| Alloy D | 44.3 | 47.9 | 47.1 |
| Al—.25Cu—Ti | 51.6 | 52.7 | 51.6 |

All of the compositions showed significant increases in conductivity with homogenization time, indicating precipitation of manganese from the super-saturated matrix. Samples homogenized at 1100° F. exhibited lower conductivity than those homogenized at 950° F., suggesting that not as much of the manganese was precipitated in the samples homogenized at 1100° F. Moreover, a larger change in conductivity from the as-cast state was observed at 950° F. than at 1100° F., which suggests more complete precipitation. The largest change in conductivity was observed in the compositions containing manganese but without titanium, e.g. Al—Mn—Cu.

In the 950° F. homogenization, manganese forms precipitates in the outermost regions of the dendrite arm microstructure resulting in a very non-uniform structure. In contrast, homogenization at 1100° F. results in a much more uniform microstructure. As will be shown hereinafter, the homogenization at 1100° F. provides a significantly improved workable material for extrusion processes or other modes of working operations.

Following the homogenization study, the billets to be used for extruded tubing were homogenized 24 hours at 1100° F. with a controlled cool down period.

Two three inch diameter billets of each composition listed in Table I were extruded on a 600 ton press using a typical one-out 1 inch wide multivoid condenser tube die. FIG. 1 illustrates an exemplary multivoid tubing made from the inventive alloy composition Inv 2 in cross-section. The billet temperature was about 1000° F. for each composition. Because of the relatively high extrusion ratio and a relatively short run out table, each billet was extruded in about five steps, each step being a partial stroke of the ram. Each partial stroke took about 10 seconds and produced about 30 feet of tubing. The 30-foot lengths of tube were subsequently cut to 5-foot lengths. The extrusion speeds ranged between 160 and in excess of 200 feet per minute with peak pressures ranging between 1300 and 1800 psi.

To simulate a brazing cycle, selected extruded multivoid tubing were given a thermal exposure. In a typical condenser application, the multivoid tubing goes through a brazing operation to attach fins thereto. To simulate the effects of this brazing cycle, a heat treating oven was preheated to between 1090° F. and 1100° F. Extruded samples were put into the hot oven and held 15 minutes to reach temperature. The samples were then withdrawn from the furnace and cooled.

With reference again to FIG. 1, a typical multivoid tubing cross-section is generally designated by the reference numeral 10 and is seen to include an outside wall section 1, a plurality of voids 3, a pair of outside radius sections 5 and a plurality of inner legs 7. Typical dimensions for the multivoid tubing include a wall thickness a of about 0.016 inches, an overall thickness b of about 0.080 inches, an overall width c approximating about 1 inch.

Figure 2:
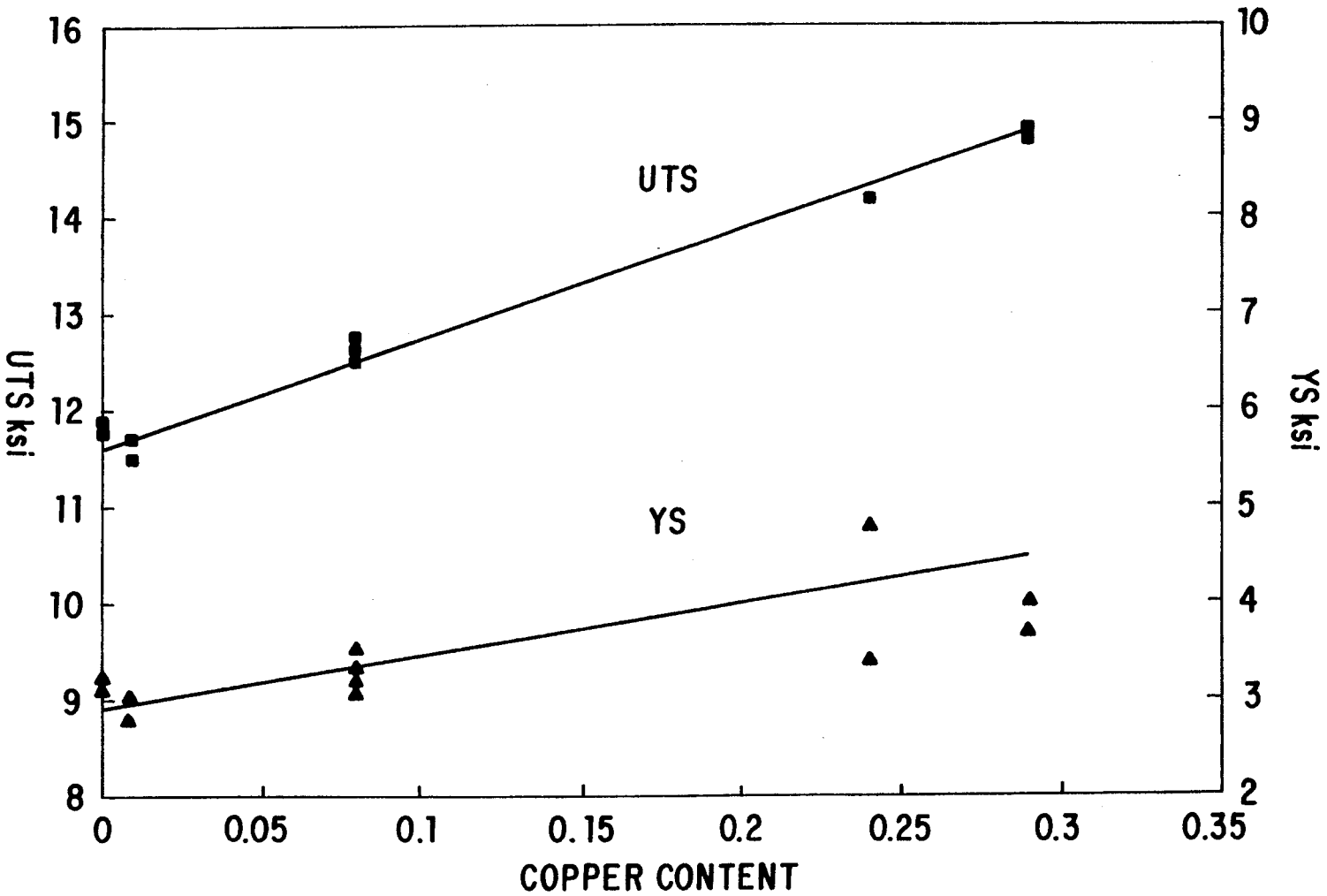
FIG. 2 shows a graph illustrating the effect of copper content on tensile strength for multivoid tubing at room temperature.

Using the above described multivoid extrusions in full cross-section, the strengths were determined. Although this does not meet with ASTM specifications, tensile properties can be compared between the various alloys for a given extruded shape. With reference now to Table III, tensile tests were conducted in the as-extruded condition and the simulated braze cycle condition as described above. The effect of copper content on strength for the multivoid experimental compositions is shown in FIG. 2. As can be seen from FIG. 2, strength increases with increasing copper content. The compositions with the special titanium additions generally had somewhat less elongation than the other compositions, e.g. Al—Mn—Cu and Alloy B.

Hot torsion tests were carried out to determine the flow stress of the various compositions at elevated temperature. Test specimens were prepared from homogenized billets in the longitudinal direction, from halfway between the outside and the center of the billet. This mode of preparation ensures uniformity of structure within each set of specimens. Test specimens were nominally 0.235 inch diameter with a two inch long gauge section, with each test specimen including an axially aligned opening in a shoulder section thereof to permit temperature monitoring during torsion testing.

TABLE III

Tensile properties of 1" wide by .016" wall multivoid extrusions of various compositions

| | AS EXTRUDED | | | AFTER BRAZE THERMAL | | |
|---|---|---|---|---|---|---|
| | UTS | YS | % elong | UTS | YS | % elong |
| #43 Alloy C | 12.99 | 4.29 | 46.0 | 12.75 | 3.35 | 44.25 |
| #47 Alloy B | 15.2 | 4.92 | 32.5 | 14.85 | 3.9 | 33.0 |
| #56 Inv 1 | 12.04 | 3.95 | 49.3 | 11.6 | 3.0 | 45.0 |
| #57 Inv 2 | 12.24 | 3.8 | 49.5 | 11.85 | 3.15 | 47.5 |
| #60 Alloy A | 12.99 | 4.01 | 45.5 | 12.65 | 3.1 | 46.5 |
| #61 Al—Mn—Cu | 14.56 | — | 35.0 | 14.2 | 4.1 | 38.0 |
| #62 Alloy D | 12.95 | 3.98 | 44.5 | 12.65 | 3.2 | 45.5 |
| #63 | | | | | | |

TABLE III-continued

Tensile properties of 1" wide by .016" wall multivoid extrusions of various compositions

| | AS EXTRUDED | | | AFTER BRAZE THERMAL | | |
|---|---|---|---|---|---|---|
| | UTS | YS | % elong | UTS | YS | % elong |
| Al—.25Cu—Ti | — | — | — | 13.55 | 2.95 | 33.5 |

The torsion test conditions were selected to approximate conditions occurring during extrusion on a commercial scale. The tests were carried out with starting temperatures at 900° F. and at 1000° F. The test machine was equipped with a tube furnace which surrounded the specimen during the test. The furnace was also used for heating the specimens to a desired test temperature. Typically, the specimens required 30 minutes to reach a desired test temperature. The non-rotating end of the torsion sample was free to move in an axial direction to reduce the probability of kinking of the specimen when subjected to high strains. The rotational speed applied to a test specimen was determined by calculating back from a selected tensile equivalent tangential strain rate. Strain rates for the torsional testing included 0.05, 0.5, 1.0, 2.0 and 4.0 seconds$^{-1}$. Failure was detected as a sudden decrease in load by computer monitoring of the load cell, failure detection also resulting in test termination.

Correlation between hot torsion test data and extrusion production parameters is difficult due to the numerous variables present during extrusion production. The temperature of the torsion test was set to the same value as a typical billet preheat temperature. The strain rate for torsion testing was chosen for efficient comparison amongst the alloys and with consideration to the high strain rates which occur in at least some parts of an extrusion, such as at the start of a die bearing surface. The maximum stress of each test was taken as the flow stress.

All of the torsion test results are summarized in Tables IVa and IVb. As shown in Tables IVa and IVb, all of the alloys with Ti exhibit a higher flow stress than Alloy A, e.g. Inv 1 versus Alloy A for a test temperature of 1000° F., homogenization temperature of 1100° F., and strain rate of 0.5 seconds$^{-1}$. Higher strain rates and lower test temperatures were shown to significantly increase the flow stress, see Inv 1 in Table IVb for a 0 5 second$^{-1}$ strain rate, homogenization temperature of 1100° F. and test temperatures of 900° F. and 1100° F. and Table IVa.

Figure 3:
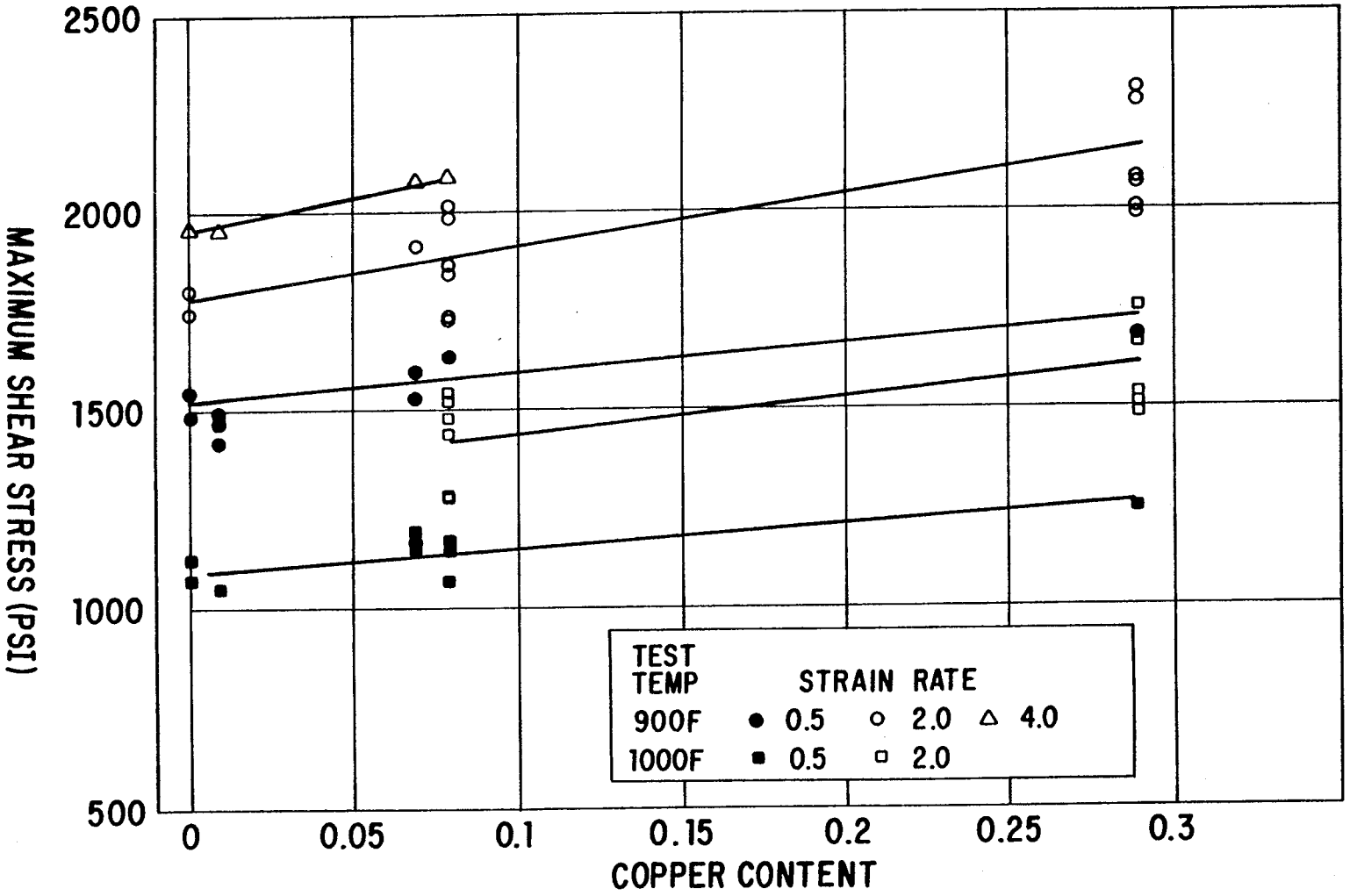
FIG. 3 shows a graph illustrating the effect of copper content on flow stress under hot torsion testing conditions.

The two most significant factors that effected the flow stress for a given temperature and strain rate were found to be the copper content and the homogenization practice. As evidenced by FIG. 3, the higher the copper content for a given alloy composition, the higher the flow stress. Moreover, the effect was more pronounced at lower test temperatures and higher strain rates. The lower homogenization temperature resulted in higher flow stress. Manganese content appeared to slightly increase the flow stress but its effects were secondary to the other variables such as copper content and homogenization practice.

TABLE IVa

TORSION TEST RESULTS, All tests at a tensile equivalent strain rate of 2.0 sec$^{-1}$

| ALLOY | TEST TEMP °F. | HOMO TEMP °F. | STRAIN RATE (sec) | SHEAR STRESS (psi) |
|---|---|---|---|---|
| Alloy A | 1000 | 1100 | 2.0 | 1486.4 |
| Alloy A | 1000 | 1100 | 2.0 | 1278.4 |
| Alloy A | 1000 | 1100 | 2.0 | 1284.9 |
| Alloy A | 900 | 1100 | 2.0 | 1730.2 |
| Alloy A | 900 | 1100 | 2.0 | 1738.4 |
| Alloy A | 900 | 1100 | 2.0 | 1847.0 |
| Alloy A | 1000 | 900 | 2.0 | 1439.7 |
| Alloy A | 1000 | 900 | 2.0 | 1538.8 |
| Alloy A | 1000 | 900 | 2.0 | 1530.0 |
| Alloy A | 900 | 900 | 2.0 | 1977.7 |
| Alloy A | 900 | 900 | 2.0 | 1980.2 |
| Alloy A | 900 | 900 | 2.0 | 2015.5 |
| Alloy B | 1000 | 1100 | 2.0 | 1486.4 |
| Alloy B | 1000 | 1100 | 2.0 | 1536.8 |
| Alloy B | 1000 | 1100 | 2.0 | 1511.6 |
| Alloy B | 900 | 1100 | 2.0 | 2002.9 |
| Alloy B | 900 | 1100 | 2.0 | 2080.5 |
| Alloy B | 900 | 1100 | 2.0 | 2068.5 |
| Alloy B | 900 | 1100 | 2.0 | 1990.3 |
| Alloy B | 1000 | 900 | 2.0 | 1671.1 |
| Alloy B | 1000 | 900 | 2.0 | 1759.1 |
| Alloy B | 900 | 900 | 2.0 | 2274.2 |
| Alloy B | 900 | 900 | 2.0 | 2308.2 |
| Alloy C | 900 | 1100 | 2.0 | 1913.7 |
| Alloy D | 900 | 1100 | 2.0 | 1862.1 |
| Inv 1 | 900 | 1100 | 2.0 | 1806.3 |
| Inv 1 | 900 | stepped* | 2.0 | 1756.3 |

*stepped homogenization: 1100° F. for 24 hours plus 950° F. for 24 hours

TABLE IVb

TORSION TEST RESULTS, All tests at a tensile equivalent strain rate other than 2.0 sec$^{-1}$

| ALLOY | TEST TEMP °F. | HOMO TEMP °F. | STRAIN RATE (sec) | SHEAR STRESS (psi) |
|---|---|---|---|---|
| Alloy A | 1000 | 1100 | 0.5 | 1074.8 |
| Alloy C | 900 | stepped* | 0.05 | 1160.9 |
| Alloy C | 1000 | 1100 | 0.5 | 1194.5 |
| Alloy C | 1000 | 1100 | 0.5 | 1145.8 |
| Alloy C | 900 | stepped | 0.5 | 1529.4 |
| Alloy C | 900 | 1100 | 0.5 | 1594.8 |
| Alloy C | 900 | 1100 | 4.0 | 2072.2 |
| Alloy D | 1000 | 1100 | 0.5 | 1152.2 |
| Alloy D | 1000 | stepped | 0.5 | 1145.8 |
| Alloy D | 1000 | 1100 | 0.5 | 1173.1 |
| Alloy D | 900 | 1100 | 0.5 | 1633.3 |
| Alloy D | 900 | 1100 | 4.0 | 2088.6 |
| Alloy B | 1000 | 1100 | 0.5 | 1248.7 |
| Alloy B | 900 | 1100 | 0.5 | 1683.7 |
| Inv 1 | 1000 | 1100 | 0.5 | 1121.4 |
| Inv 1 | 1000 | stepped | 0.5 | 1075.3 |
| Inv 1 | 900 | stepped | 0.5 | 1482.3 |
| Inv 1 | 900 | 1100 | 0.5 | 1543.6 |
| Inv 1 | 900 | 1100 | 4.0 | 1955.2 |
| Inv 2 | 1000 | 1100 | 0.5 | 1048.3 |
| Inv 2 | 1000 | stepped | 0.5 | 1048.3 |
| Inv 2 | 900 | stepped | 0.5 | 1424.3 |
| Inv 2 | 900 | 1100 | 0.5 | 1495.5 |
| Inv 2 | 900 | stepped | 0.5 | 1473.0 |
| Inv 2 | 900 | 1100 | 4.0 | 1952.7 |

In extrusions, the maximum shear stress is approximately at the point at which the billet has been crushed to fill the container and the die cavity has not been filled. The metal is then forced forward only by shear along the container walls and by shear at the die opening. On this basis, it is reasonable that the values of flow stress determined in the torsion test are applicable to commercial extrusion conditions.

The multivoid tubing described above in the various compositions depicted in Table I was tested for corrosion performance. Samples of the multivoid tubing as-produced in the method described above, were tested using a cyclic salt-water acetic acid spray test environment conforming to ASTM standards (hereinafter SWAAT). The testing was performed on the multivoid tubing with and without the simulated braze thermal heat treatment as described above. Specimens of each alloy composition were cut to six inch lengths and sealed at each end. Individual specimens were exposed for various selected times ranging from 1-35 days. After exposure, specimens were cleaned in an acid solution to remove the corrosion products. Leaks were counted by pressurizing the tubes at 10 psi with nitrogen and immersing the specimens in water. The number of corrosion perforations on each piece were recorded as a function of exposure time. Determination of the number of perforations in the sample specimens permits evaluation of the corrosion performance in the test environment.

The results of the corrosion testing are shown in Table V. Alloy A and Al—Mn—Cu composition had perforations due to corrosion after much shorter times than the compositions having a titanium addition. Of the high titanium compositions with manganese, e.g. Alloy C, Alloy B, Inv 1 and Inv 2, the compositions with the lowest copper content appear to go the longest without perforating. For times greater than 20 days, the inventive alloys performed better than prior art alloys.

Figure 4A:
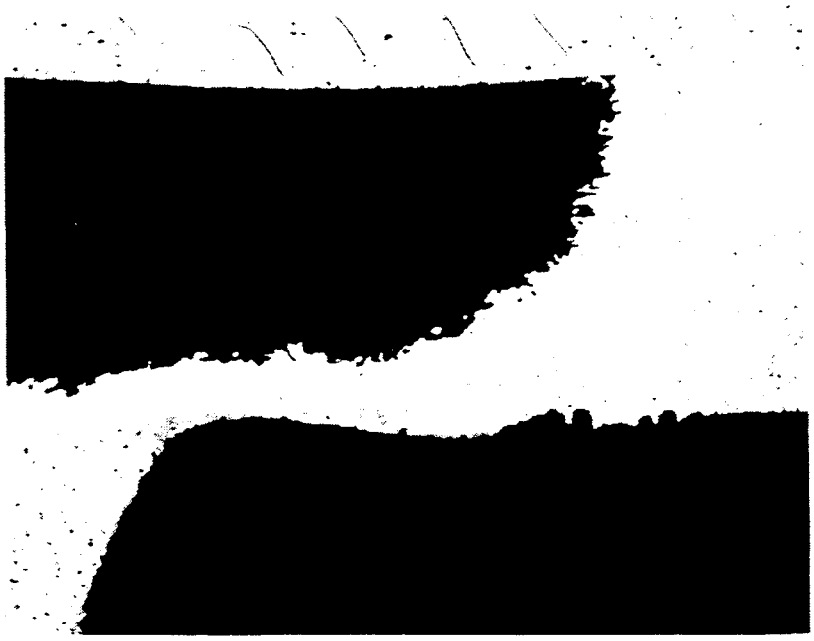
FIG. 4*a* shows a photomicrograph at 100 times magnification showing a transverse section of the inventive alloy.
Figure 4B:
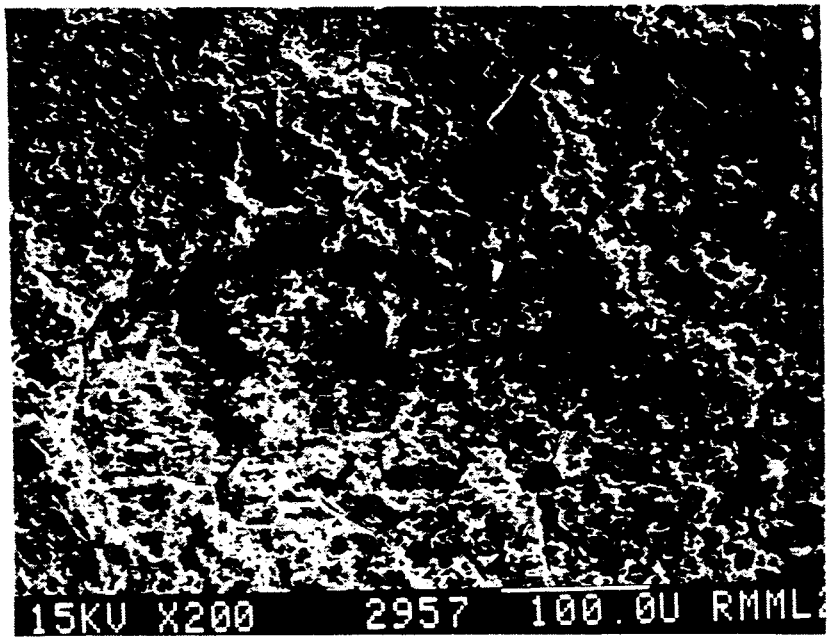
FIG. 4*b* shows a SEM surface micrograph at 200 times magnification of the alloy shown in FIG. 4*a;*
Figure 5A:
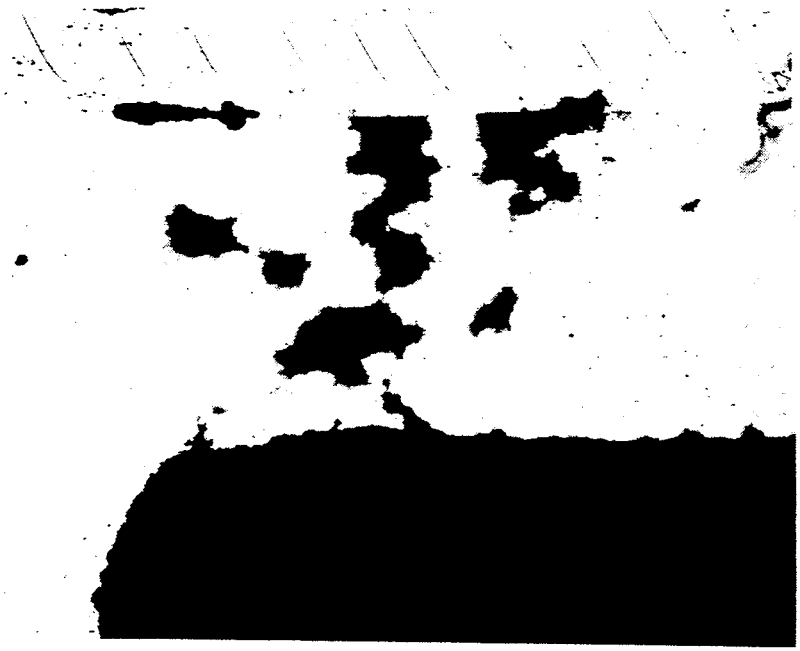
FIGS. 5*a* and 5*b* show micrographs similar to those described for 4*a* and 4*b* but for a prior art alloy composition.

The mode of attack during the corrosion testing was examined using metallographic sections and with a scanning electron microscope (hereinafter SEM). FIGS. 4*a* and 4*b* illustrate a typical corrosion attack for the inventive alloy Inv 2. FIG. 4*a* shows a lamellar attack runs parallel to the surface. In contrast, the prior art alloy depicted in FIG. 5*a* exhibits a pitting attack.

TABLE V

| | Number of perforations in 5" lengths of tube after SWAAT exposure for the indicated number of days. | | | | | | |
|---|---|---|---|---|---|---|---|
| DAYS | ALLOY C | ALLOY B | INV 1 | INV 2 | ALLOY A | Al—Mn—Cu | ALLOY D |
| 1 | 0 | 0 | 0 | 0 | 0 | 0 | 0 |
| 2 | 0 | 0 | 0 | 0 | 1 | 0 | 0 |
| 3 | 0 | 0 | 0 | 0 | 2 | 3 | 0 |
| 4 | 0 | 0 | 0 | 0 | 1 | 2 | 0 |
| 5 | 0,0* | 0,0* | 0,0* | 0,0* | 3,5* | 3,1* | 0 |
| 6 | 0 | 0 | 0 | 0 | 0 | 3 | 0 |
| 7 | 0 | 0 | 2 | 0 | 6 | 7 | 0 |
| 8 | 0 | 0 | 0 | 0 | 9+ | 9+ | 0 |
| 9 | 0 | 0 | 0 | 0 | 9+ | 10+ | 0 |
| 10 | 0 | 0 | 0 | 0 | 8 | 10+ | 1 |
| 11 | 0 | 0 | 0 | 0 | 10+ | 12+ | 1 |
| 12 | 1,0* | 0,0* | 0,0* | 0,0* | 15+ | 14+ | 1 |
| 13 | 1 | 0 | 1 | 0 | 15+ | 14+ | 0 |
| 14 | 0 | 0 | 1 | 0 | | | 1 |
| 15 | 1,0* | 0,0* | 1,0* | 0,0* | 8* | 8* | 0 |
| 16 | 1 | 0 | 0 | 0 | | | 0 |
| 17 | 1 | 0 | 0 | 0 | | | 0 |
| 18 | 1,0* | 0,0* | 0,0* | 0,0* | 10* | 12* | 0 |
| 19 | 1 | 0 | 0 | 0 | | | 0 |
| 20 | 2,0* | 4,0* | 0,0* | 0,3* | 15* | 15* | 0 |
| 22 | 5 | 2 | 0 | 0 | | | 1 |
| 23 | 4 | 4 | 0 | 0 | | | 2 |
| 24 | 8 | 3 | 0 | 0 | | | 0 |
| 25 | 4,0* | 5,0* | 0,0* | 5,2* | 14* | 15* | 0 |
| 26 | 2 | 4 | 0 | 0 | | | 1 |
| 27 | 1 | 3 | 0 | 0 | | | 0 |
| 28 | 2 | 3 | 2 | 0 | | | 2 |
| 29 | 5 | 8 | 2 | 0 | | | 0 |
| 30 | 2 | 6 | 2 | 0 | | | 0 |
| 35 | 14 | 15 | 3 | 0 | | | 0 |

*TESTED WITHOUT A BRAZE THERMAL.

Figure 5B:
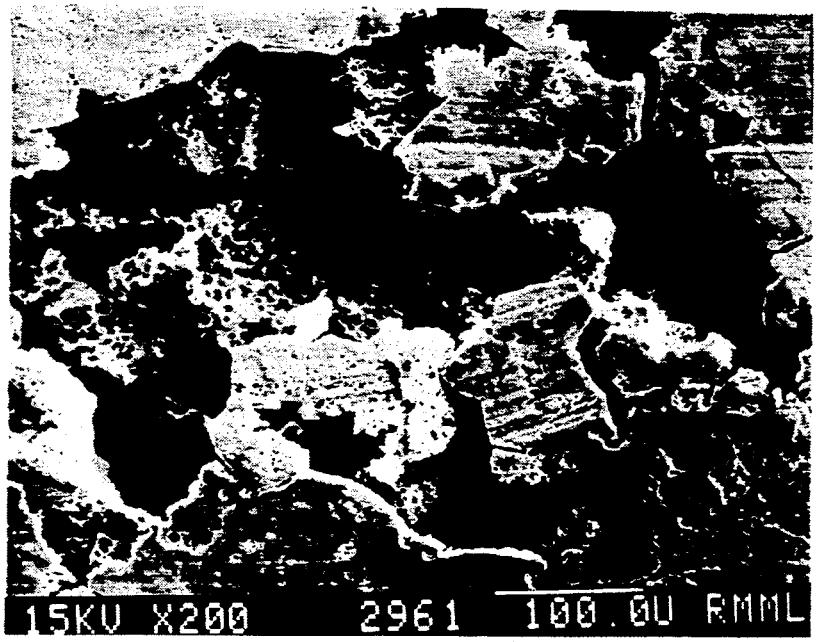

In the SEM micrographs, in particular FIG. 4*b*, the corrosion attack appears as flat-bottom shallow pits in the titanium containing inventive alloy and as deep creviced pits with spongy bottoms for the compositions without titanium as shown in FIG. 5*b*. The lamellar mode of attack was present in all of the compositions containing titanium. Compositions with titanium, manganese and copper together exhibited the highest degree of lamellar attack.

In U.S. Pat. Nos. 4,828,794 and 4,629,087 as described above, the effect of adding titanium has been addressed only in compositions with a significant amount of manganese. With reference again to Table V, and the micrographs depicted in FIG. 4*a*, 4*b*, 5*a* and 5*b*, all of the compositions with manganese and titanium in combination showed the lamellar mode, indicating a layered microstructure.

Comparing compositions with titanium and varying copper content, the lamellar attack is present but is less pronounced at the lower copper amounts. Thus, the mode of attack in Inv 1 was less lamellar than in Alloys B, C, or D. However, and based upon the results in Table V, the essentially copper-free composition Inv 2 exhibited superior corrosion performance in the SWAAT environment indicating a generally slower rate of attack.

In demonstrating the improved extrudability associated with the inventive alloy composition, a comparison was made between alloy compositions Alloy E and Alloy F and the inventive alloy, Inv 3.

Compositions of the alloys used in the extrudability study are shown in Table VI, with the balance of the billets being aluminum. The compositions were cast as 8 inch diameter logs and cut to 24 inch lengths. The Alloy F and Inv 3 alloys were homogenized for 24 hours at 1100° F. using a 75° F. per hour heating rate and a 50° F. per hour cooling rate. The homogenized billets of each composition were extruded into 0.236 inch diameter by 0.016 inch wall tubing.

During extrusion, the trail runs were performed as close to commercial practice as possible.

Figure 6:
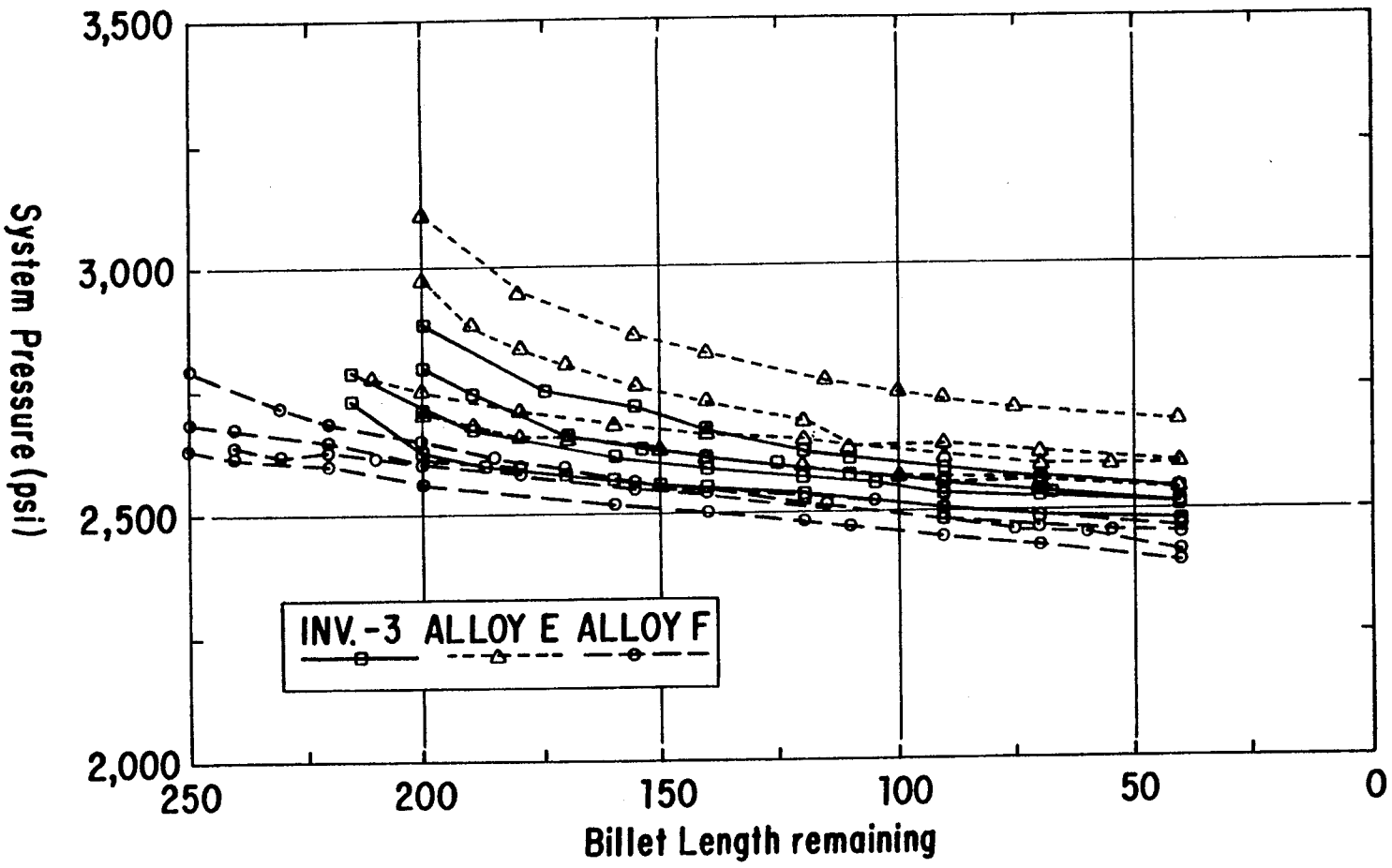
FIG. 6 shows a graph comparing extrusion pressure and billet length remaining for the inventive alloy and two prior art alloys.

FIG. 6 shows the relationship between extrusion system pressure and remaining billet length. As is evident from this graph, the required system pressures for the inventive alloy, Inv 3, is less than the prior art alloy composition, Alloy F and greater than the prior art alloy composition, Alloy E. Accordingly, extrusion of the inventive alloy should provide for more economical operation due to reduced wear on tooling and equipment an higher extrusion speeds at a given pressure level than Alloy F.

TABLE VI

| | Compositions of extrusions billets | | | | | | |
|---|---|---|---|---|---|---|---|
| | Si | Fe | Cu | Mn | Mg | Ti | others |
| Alloy E | .05 | .47 | .03 | .28 | <.01 | .03 | <.01 |
| Alloy F | .08 | .22 | .07 | .29 | <.01 | .15 | <.01 |
| Inv 3 | .08 | .22 | <.01 | .29 | <.01 | .15 | <.01 |

Figure 7:
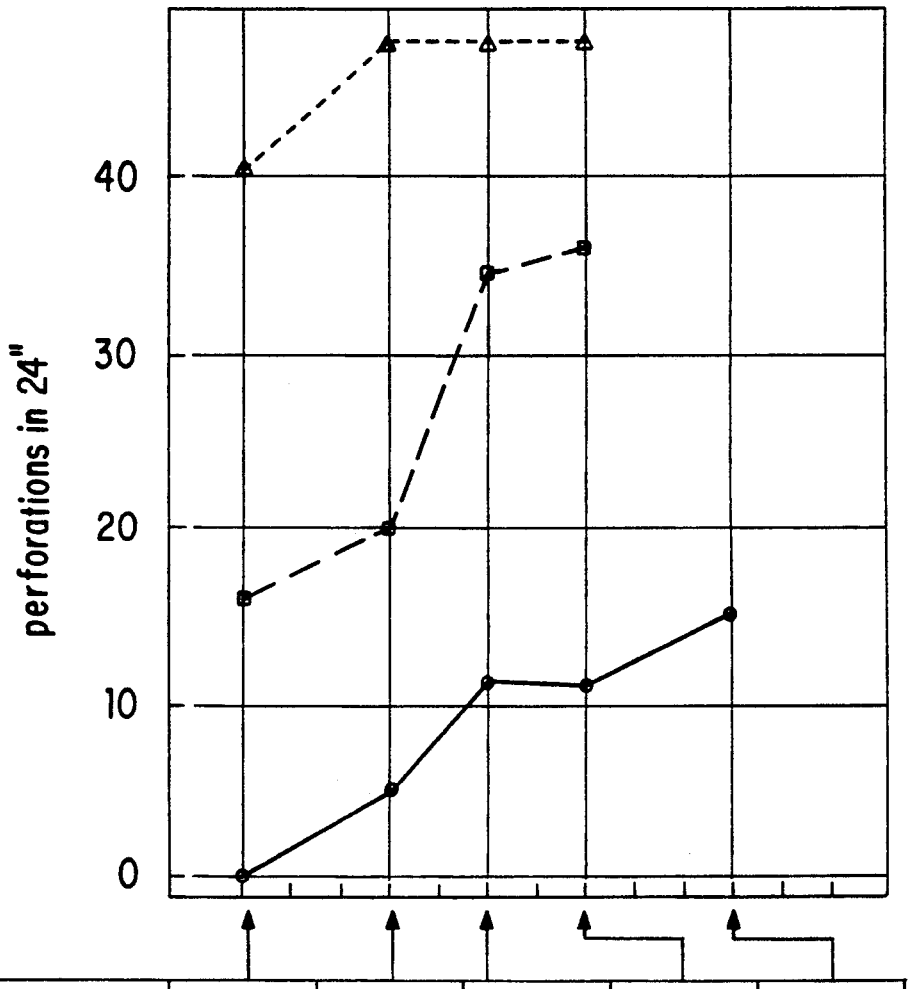
FIG. 7 shows a graph of corrosion performance for the inventive alloy and two prior art alloys.

Further corrosion testing was performed on the compositions used in the extrudability study. FIG. 7 shows the SWAAT test results for 0.236 inch diameter heat exchanger tubing, comparing the total number of perforations in four pieces of 6 inch long tubing after exposure in SWAAT for a predetermined number of days. As can be seen from FIG. 7, the inventive alloy provides improved corrosion performance over both of the prior art alloys.

Table VII depicts mechanical properties of the three alloys.

Table VII depicts mechanical properties of the three alloy compositions used in the extrudability investigation. During mechanical testing, no thermal exposures were performed on the heat exchanger tubing. Moreover, the as-produced conditions include one pass through a sink die, which introduces a small amount of cold work. The tubing samples were tested for tensile strength using 10 inch lengths of tube with no reduced section. Burst pressure was evaluated using multiple samples of each composition. As can be seen from Table VII, the inventive alloy was not as strong as either of the inventive alloy cold work due to sinking by extruding the inventive alloy tubing at a slightly larger diameter. Moreover, increasing the extrusion size provides an increase of production from the extrusion press.

TABLE VII

| | Tensile and Burst Pressure Results for as-produced 6 mm heat exchanger tubing | | | |
|---|---|---|---|---|
| | UTS | YS | % elong | BURST PRESSURE |
| Alloy E | 13.2 | 10.8 | 35.4 | 1920 |
| Alloy F | 12.5 | 10.7 | 30.8 | 1980 |
| Inv 3 | 11.6 | 9.8 | 34.9 | 1830 |

As is evident from the comparisons made above with respect to corrosion performance, mechanical properties and extrudability, the inventive alloy composition provides a high level of corrosion resistance with improved extrudability. The improvements in extrudability permit advantages in production extrusion practice as a result of increased extrusion press speed and decreased extrusion pressures.

The process provided by the invention includes the following steps:

a.) casting a billet having a composition consisting essentially of about 0.1–0.5% by weight of manganese (preferably between about 0.25 and 0.35% by weight), between about 0.05 and 0.12% by weight of silicon, between about 0.10 and 0.20% by weight of titanium (preferably between about 0.12 and 0.17% by weight), between about 0.15 and 0.25% by weight of iron, not more than 0.01% by weight of copper, the balance being aluminum and incidental impurities;

b.) homogenizing the billet at a temperature between about 750° F. and about 1180° F.;

c.) cooling the billet to ambient temperature;

d.) heating the billet to an elevated temperature, for instance between about 600° F. and 1180° F., preferably between about 800° F. and 1,000° F.; and e.) extruding the billet to provide an improved product having high corrosion resistance.

The term "billet" is used in a broad context in the preceding. For instance, in steps a.) to c.) the term can mean a log that is cut into individual billets prior to step d.). Also, the billet can be scalped prior to step d.), especially if the billet is to be extruded in an indirect extrusion press. In one embodiment of the process, step c.) includes controlled cooling of the billet at a rate of less than 200° F. per hour from the homogenization temperature to a temperature of about 600° F. or less, followed by air cooling to ambient temperature. The controlled cooling can occur in the furnace used to homogenize the billet by a controlled reduction in furnace temperature. Step e.) can use an extrusion ratio greater than 200, for instance an extrusion ratio of at least 500.

Although the inventive alloy composition has been disclosed as multivoid and round heat exchanger tubing, other applications are contemplated by the present invention. The same composition may be used to produce finstock for heat exchangers, corrosion resistant foil for use in packaging applications subjected to corrosion from salt water, and other extruded articles.

As such, an invention has been disclosed in terms of preferred embodiments thereof which fulfill each and every one of the objects of the present invention as set forth hereinabove and provides both an improved process and a new and improved aluminum-based alloy composition having improved corrosion resistance and extrudability.

Of course, various changes, modifications and alterations from the teachings of the present invention may be contemplated by those skilled in the art without departing from the intended spirit and scope thereof. Accordingly, it is intended that the present invention only be limited by the terms of the appended claims.

Having thus described the invention and certain embodiments thereof, what is claimed is:

1. An aluminum-based alloy consisting essentially of at least 0.1 and not more than 0.29% by weight of manganese, about 0.05–0.12% by weight of silicon, about 0.10–0.20% by weight of titanium, about 0.15–0.25% by weight of iron, less than 0.03% by weight of copper and the balance aluminum and incidental impurities, said aluminum-based alloy exhibiting high corrosion resistance and being capable of being extruded using a high extrusion ratio.

2. The alloy of claim 1 wherein said copper content ranges between zero and about 0.01% by weight.

3. The alloy of claim 1 wherein said titanium ranges between about 0.11–0.17% by weight.

4. The alloy of claim 1 wherein said iron and manganese are determined according to the following:

$$Fe_{wt\%} < 2.5\ (Si_{wt\%})$$

$Mn_{wt\%} \geqq 2.0\ (Si_{wt\%})$

5. An aluminum-based alloy consisting essentially of less than about 0.01% by weight of copper, about 0.22% by weight of manganese, about 0.10 by weight of silicon, about 0.21% by weight of iron, about 0.14 to 0.16% by weight of titanium and the balance aluminum and incidental impurities, said aluminum-based alloy exhibiting high corrosion resistance and being capable of being extruded using a high extrusion ratio.

6. The alloy of claim 1 wherein said alloy is formed into a plate billet or ingot.

7. A multivoid extrusion containing an alloy of claim 1.

8. A foil material containing an alloy of claim 1.

9. An extruded tube containing an alloy of claim 1.

10. A multivoid extrusion containing an alloy of claim 3.

11. A foil material containing an alloy of claim 3.

12. An extruded tube containing an alloy of claim 5.

13. The alloy of claim 1 wherein no individual impurity is present in an amount greater than 0.03% by weight and the total amount of impurities is not greater than 0.10% by weight.

14. A process for extruding a product having high corrosion resistance, said process comprising:

a.) casting a billet having a composition consisting essentially of about 0.1 to 0.5% by weight of manganese, about 0.05 to 0.12% by weight of silicon, about 0.10 to 0.20% by weight of titanium, about 0.15 to 0.25% by weight of iron, not more than 0.01% by weight of copper, the balance being aluminum and incidental impurities;

b.) homogenizing the billet at an elevated temperature;

c.) cooling the billet;

d.) heating the billet to an elevated temperature; and e.) extruding the billet to provide an improved product having high corrosion resistance.

15. The process of claim 14 wherein the cooling step includes controlled cooling of the billet at a rate of less than 200° F. per hour from the homogenization temperature to a temperature of about 600° F.

16. The process of claim 14 wherein an extrusion ratio greater than 200 is used in the extrusion step.

17. The process of claim 14 wherein an extrusion ratio of at least 500 is used in the extrusion step.

* * * * *